United States Patent [19]

Nakamura et al.

[11] Patent Number: 4,744,384

[45] Date of Patent: May 17, 1988

[54] AUTOMATIC GAS DISTRIBUTING DEVICE CONTROLLED BY A DIRECT APPLICATION OF HIGH GAS PRESSURE OF A SOURCE FOR SUPPLYING A PIPE WITH GAS FROM AN ALTERNATIVE GAS SOURCE

[75] Inventors: Masaki Nakamura, Yokohama; Nobuo Fujie; Hiroyuki Okamoto, both of Kawasaki, all of Japan

[73] Assignee: Fujitsu Limited, Kanagawa, Japan

[21] Appl. No.: 74,607

[22] Filed: Jul. 17, 1987

[30] Foreign Application Priority Data

Jul. 18, 1986 [JP] Japan ..... 61-170386

[51] Int. Cl.[4] ..... F17C 13/04

[52] U.S. Cl. ..... 137/110; 137/113; 222/6

[58] Field of Search ..... 137/113, 114, 110; 222/6, 66, 145

[56] References Cited

U.S. PATENT DOCUMENTS 3,513,751 5/1970 Escobosa ..... 137/113 X
3,658,081 4/1972 Renaudie ..... 137/113
4,341,234 7/1982 Meinass et al. ..... 137/110
4,597,406 7/1986 Loiseau et al. ..... 137/113

FOREIGN PATENT DOCUMENTS 1099294 2/1961 Fed. Rep. of Germany ..... 137/113

*Primary Examiner*—Martin P. Schwadron
*Assistant Examiner*—Stephen M. Hepperle
*Attorney, Agent, or Firm*—Armstrong, Nikaido, Marmelstein & Kubovcik

[57] ABSTRACT

An automatic gas distributing device delivers gas at a constant predetermined pressure from one of a plurality of high pressure vessels arranged in a ring connection. The device has flow paths corresponding to the high pressure vessels, and is controlled by the direct application of pressures of the gas contained in the associated vessels to the relevant stop valves. The device automatically sets into operation a high pressure vessel having a lower gas pressure than other vessels. The device interrupts the high pressure vessel in operation when the gas pressure of the vessel is reduced below a control pressure, and actuates the succeeding vessel.

12 Claims, 7 Drawing Sheets

AUTOMATIC GAS DISTRIBUTING DEVICE CONTROLLED BY A DIRECT APPLICATION OF HIGH GAS PRESSURE OF A SOURCE FOR SUPPLYING A PIPE WITH GAS FROM AN ALTERNATIVE GAS SOURCE

BACKGROUND OF THE INVENTION

The present invention relates to an automatic gas distributing device used in a gas supply system. The gas supply system has a gas source stored under high pressure in a plurality of high pressure vessels. Particularly, the present invention relates to an automatic gas distributing device which automatically exchanges an operational flow path from a high pressure vessel for that from another high pressure vessel on standby at full gas pressure without dropping the supply gas pressure during the exchange period.

In a chemical vaporizing deposition (CVD) fabrication process of a semiconductor device, various gases, such as silane ($SiH_4$), hydrogen ($H_2$) etc., are used. Generally, these gases are supplied to a fabrication apparatus under a tightly controlled predetermined gas pressure which is required to be maintained within a small variation range in order to perform the relevant fabrication process in a stable and reliable state. Accordingly, a drained high pressure vessel, which has a reduced gas pressure below a specified control pressure, will be exchanged for a new high pressure vessel on stand-by, which stores the gas at full pressure. During the exchange interval it is important to maintain a constant supply gas pressure so that no pressure drop of the supply gas is allowed throughout the entire exchange interval.

A prior art gas supply system is described with reference to the schematic diagram of FIG. 1. The system contains a gas distributing device for supplying gas continuously from two high pressure vessels 1 and 2 alternatively to a utilization pipe to be connected to a fabrication apparatus. The high pressure vessel, 1 or 2, is connected to, or disconnected from the system using a connecting valve 3 or 4, respectively. During the exchange interval, shut-off valves 5 and 6 are closed. The pressure of the gas (hereinafter, primary pressure) of the high pressure vessel 1 or 2, is regulated by a regulator 7 or 8, to a low pressure (hereinafter secondary pressure). The low pressure is the pressure at which the gas is utilized. The regulated gas is sent to utilization pipe (not shown), through a directional control valve 19 which is operated automatically or manually. Gas pressure indicators 11 and 12, are disposed upstream of the gas regulators 7 and 8, respectively. The gas pressure indicators 11 and 12 indicate the respective primary pressure. Downstream of the regulators 7 and 8, other indicators 13 and 14 indicate the secondary pressure. During manual operation of the device, the primary pressure of the high pressure vessels 1 or 2, is ready by an operator and one of the vessels 1 and 2 is selected by operating the directional control valve 19 after determining that the secondary pressure of the relevant vessels reaches the specified utilization gas pressure. During automatic operation of the device, the pressure indicators 11 and 12 are replaced by pressure signal generators, and the directional control valve 19 is replaced by an electrically or pneumatically driven directional control valve which operates in accordance with signals issued by the pressure signal generators. Thus, the drained high pressure vessel, having a primary pressure below a predetermined control pressure, is replaced by a full high pressure vessel. Consequently, the gas under the utilization gas pressure is supplied to the utilization pipe without any break or pressure drop. However, in the above-described automatic control system, an electrical and pneumatic power source are required to be used and therefore the system is more complicated and expensive than a manual system. In particular, when the power source is disabled, the operation of the entire gas supply system is stopped, which causes substantial damage to the fabrication process.

The above-described prior art gas distributing device has been occasionally been plagued by occasional misoperation and/or high labor operational cost of the operators. In order to overcome these disadvantages, various improved automatic gas distributing devices have been proposed. Most of them are of the type where the change of the secondary pressure of the gas is detected by deformation of a diaphragm member. The deformation is converted into an electrical control signal which is sent to the relevant control valves. However, the change of the secondary pressure can be very small, particularly, when the change of the secondary pressure is required to be strictly controlled as in the semiconductor fabrication apparatus. As a result, the regulation of the control signal is a very delicate operation which can decrease the accuracy of the control operation. Furthermore, if the relevant gas is corrosive, or explosive, the use of electrical components is rather undesirable in view of the safety and the reliability of the gas supply system.

One proposed automatic gas distributing device has a primary pressure of the gas source utilized as a power source of the device. The device is an automatic gas delivery device disclosed by Gerard Loiseau et al in U.S. Pat. No. 4,597,406 published on July 1, 1986. Usually, the change of the primary pressure of the high pressure vessels is large and advantageous to provide sensitive control signals for controlling the gas delivery device. In the automatic gas delivery device of Loiseau et al, various conventional pneumatic elements are utilized for detecting the primary pressure of the two high pressure vessels, one of which is in operation and the other of which is on standby. Gas flow coming from the high pressure vessel, which is drained below a predetermined pressure, is automatically exchanged for that from a full high pressure vessel on stand-by. The whole control system is driven by the aid of pneumatic controlling elements. Although there are advantages inherent to the device, such as the absence of an electrical power source, the source of a number of pneumatic elements are considered to make the device complicated and expensive.

SUMMARY OF THE INVENTION

An object of the present invention, is to provide an automatic gas distributing device for automatically controlling the delivery of low pressure gas coming from a number of high pressure vessels, in order to send the gas to a utilization pipe.

Another object of the present invention is to provide an automatic gas distributing device which delivers the remaining gas under a precisely controlled pressure to a utilization pipe, even during the time of switching-over from a drained high pressure vessel to a full high pressure vessel on stand-by.

Still another object of the present invention is to provide an automatic gas distributing device which is operable in accordance with the primary pressure of the relevant high pressure vessels without the aid of another external power source, thus having a simple and non-expensive structure.

FIG. 2 is a schematic diagram illustrating gas supply flow paths of the first embodiment of the present invention, in which two high pressure vessels are used. The high pressure vessels 1 and 2, have primary pressures $P_1$ and $P_2$ respectively, and are connected or disconnected to the relevant gas supplying apparatus using valves 3 and 4 respectively. The primary gas pressures $P_1$ and $P_2$ are regulated by regulators 7 and 8 to a utilization pressure, namely a secondary pressure $P_0$. The gas under the pressure $P_0$, namely the low pressure gas, is supplied through a supply pipe 58 or 59 to an automatic gas distributing device 20. The low pressure gas under the gas pressure $P_0$ is alternatively supplied from one of the high pressure vessels 1 and 2 under the control of the automatic gas distributing device 20. The gas is then supplied through a commonly used utilization pipe 60 to a fabrication apparatus which uses the gas, such as a CVD apparatus.

As shown in FIG. 2, the automatic gas distributing device 20 has two flow paths 9 and 10 disposed in parallel, corresponding to the high pressure vessels 1 and 2. Each flow path includes a parallel flow path and a flow path connected to the parallel path in series. In the flow path 9 corresponding to the high pressure vessel 1, for example, the parallel flow path comprises two branch paths respectively including a stop valve 27 operable by the pressure difference between the primary pressures $P_1$ and $P_2$, and another stop valve 28 operable in accordance with the primary pressure $P_2$ of the other high pressure vessel 2. A flow path is connected in series with the above-described parallel flow path which includes a stop valve 29 operable in accordance with the primary pressure $P_1$ of the high pressure vessel 1. Thus, the flow path 9 comprises a flow path including the stop valve 28 and stop valve 29 connected in series, and a flow path including the stop valve 27, by-passing the stop valve 28.

These stop valves may be conventional seat valves, each comprising a valve seat, a valve plunger, a coil spring, and a piston connected to the end of the plunger, as shown in FIG. 3. Conventional pilot valves are also applicable instead of the seat valves. When the pressures $P_1$ is higher than a predetermined control pressure $P_c$, the stop valve 29 is opened and the stop valve 31 is closed, or vice versa when the pressures $P_1$ is below the control pressure $P_c$. In accordance with the pressure $P_2$, the stop valves 32 and 28 operate in the similar manner. The control pressure $P_c$ is determined to be a pressure approximately equal to the utilization pressure $P_0$. The stop valves 27 and 30 are mechanically connected to each other, and cooperate with each other. When the pressure $P_1$ is lower than the pressure $P_2$, the stop valve 27 is opened, and the stop valve 30 is closed. Similarly, the opposite occurs when $P_1$ is higher than $P_2$. Thus, if one pressure gas vessel in operation is drained, then the other vessel on stand-by operates automatically, and if both vessels have high primary pressures, then the vessel having a lower primary pressure is selectively operated and the other vessel remains on stand-by.

The dot lines in FIG. 2 indicate the relevant actuating paths 15 and 16 for propagating the primary pressures $P_1$ and $P_2$ to the associated stop valves to drive the stop valves. As described above, all the stop valves are driven by the primary pressures of the high pressure vessels $P_1$ and $P_2$ propagated through the actuating paths 15 and 16.

Furthermore, the principle of the above-described structural configuration and the operation, is extended to an automatic gas distributing device for a gas supply system having more than two high pressure vessels.

The details of an automatic gas distributing device according to the present invention, will be more apparent by the following description of embodiments and claims, by referring to the accompanying drawings wherein like reference numerals designate like parts.

DESCRIPTION OF THE PREFERRED EMBODIMENT

Figure 1:
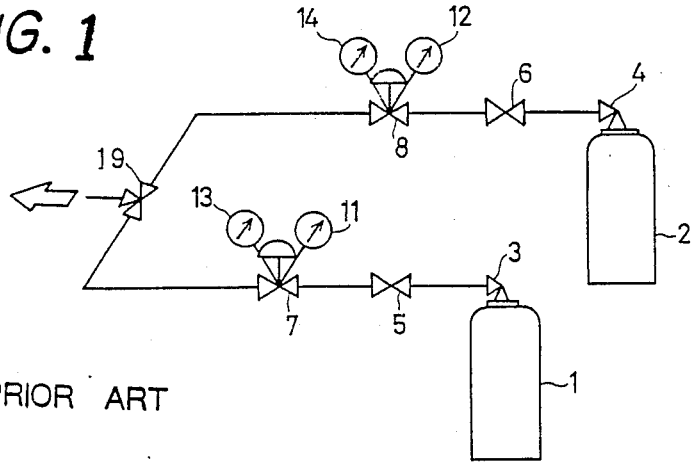
FIG. 1 is a schematic diagram, illustrating a prior art gas supplying system.
Figure 2:
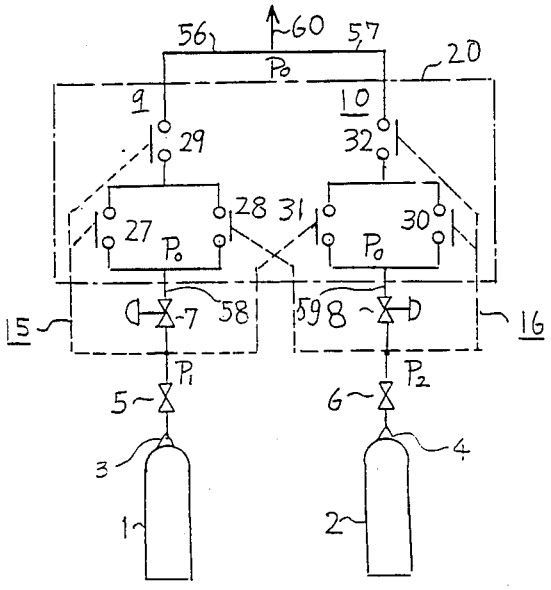
PRIOR ART FIG. 2
FIG. 2 is a schematic diagram illustrating gas supply flow paths of the first embodiment of the present invention.
Figure 3:
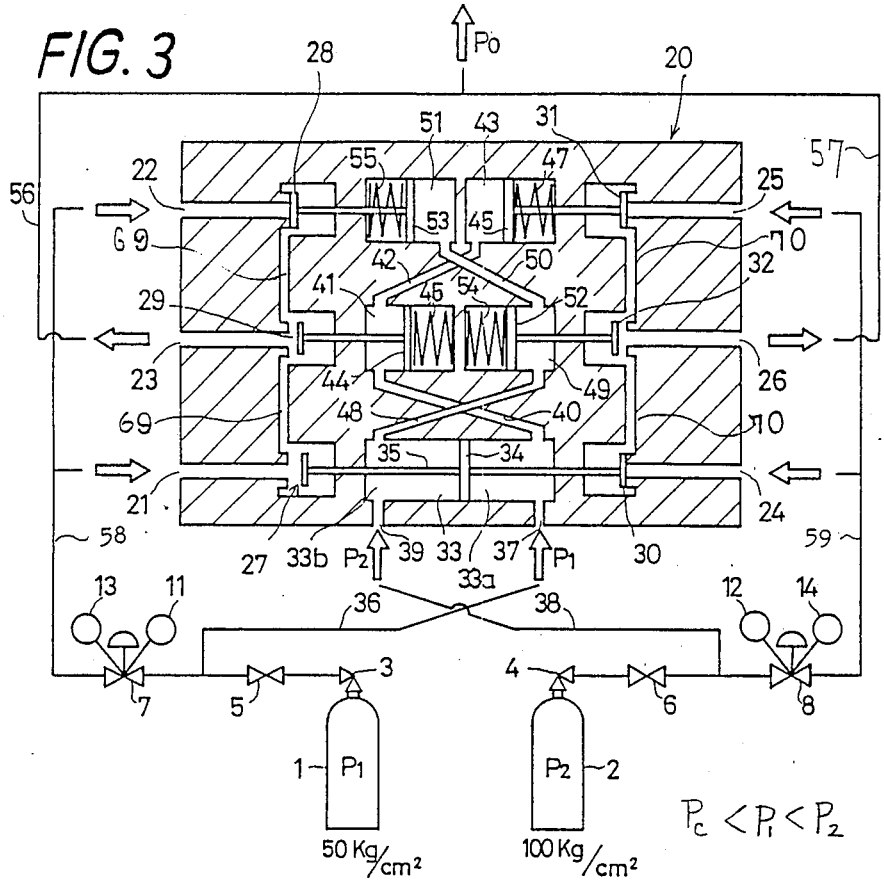
FIG. 3 is a schematic cross-sectional view of a first embodiment of the present invention, illustrating the structural configuration of an automatic gas distributing device.

FIG. 3 is a schematic cross-sectional view of a first embodiment of the present invention, illustrating the structural configuration of an automatic gas distributing device 20.

As shown in FIG. 3, the gas coming from the high pressure vessel 1 is supplied to the automatic gas distributing device 20 through inlet ports 21 and 22, and is issued into a supply pipe 56 through a path 69 and an outlet port 23. Similarly, the gas coming from the high pressure vessel 2 is supplied to the automatic gas distributing device 20 through inlet ports 24 and 25, and is issued into a supply pipe 57 through path 70 and an outlet port 26. Stop valves 29 and 31 are driven by primary pressure $P_1$, stop valves 32 and 28 by primary pressure $P_2$, and stop valves 27 and 30 by the difference between the primary pressures $P_1$ and $P_2$. The primary pressures $P_1$ and $P_2$ are applied to the above stop valves through actuating paths 15 or 16 (reference numerals 15 and 16 are not shown), and open and close the inlet or outlet ports, 21, 22, 23, 24, 25, and 26.

Figure 4:
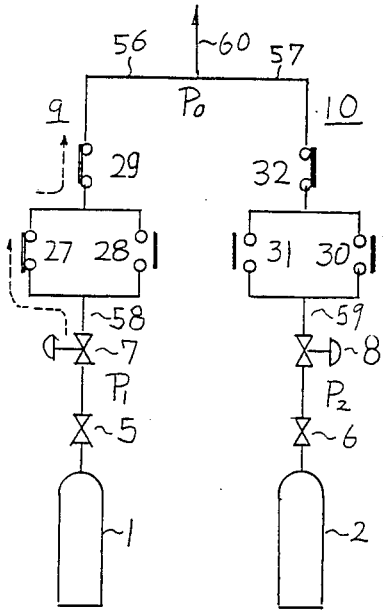
FIG. 4 is a diagram illustrating a gas flow of the automatic gas distributing device which is in the state shown in FIG. 3.

FIG. 4 is a diagram illustrating a gas flow of the automatic gas distributing device which is in the state shown in FIG. 3. The stop valves are represented in the analogy of an electrical switching circuit using electrical switches, wherein an ON switch corresponds to an open stop valve, and an OFF switch corresponds to a closed stop valve. The flow path 9 comprises inlet ports 21 and 22, outlet port 29, connecting flow paths 69 disposed between the stop valves 27, 28, and 29. By controlling the stop valves, the flow paths including stop valves 28 and 29 can be connected in series and the stop valve 28 and can be by-passed by a passage including the inlet port 21, the stop valve 27, the flow paths 69 and the outlet port 23. Another flow path 10 has also a similar configuration to the flow path 9 where the flow path 10 includes the stop valve 31 and stop valve 32 connected in series. The stop valve 31 is by-passed by another path including the inlet port 24, the stop valve 30, the path 70, and the outlet port 26. The flow path 9 is opened and gas flows from the high pressure valve 1 when the two stop valves 29 and 27, or the two stop valves 29 and 28, are opened at the same time. The flow path 10 is opened or closed in a similar way.

The described stop valves are conventional seat valves. Each valve comprises a valve seat, a valve plunger, a piston connected to the valve plunger, a cylinder hall slidably holding the piston, and a coil spring energizing the plunger in a direction to close or open the valve depending on its use. In practice, the piston is often replaced by a diaphragm. The displacement of the valve plunger in the axial direction is provided by the deformation of the diaphragm caused by a pressure of applied gas pressure to the valve.

Of course, these seat valves can be replaced by plunger valves or pilot valves. The stop valves 28 and 31 are energized by an individual coil spring which is disposed with respect to each valve plunger such that the stop valves 28 and 31 are closed when the exposed gas pressure $P_1$ or $P_2$ is higher than a predetermined control pressure $P_c$, and vice versa when the pressure $P_1$ or $P_2$ is below the control pressure $P_c$. The stop valves 29 and 32 are energized such that the stop valves 29 and 32 are opened when the exposed gas pressure is higher than a predetermined control pressure $P_c$, and vice versa when the pressure $P_1$ or $P_2$ is below the control pressure $P_c$.

The stop valves 27 and 28 are mechanically connected by a connecting rod 35. At the mid-point of the connecting rod 35 is a piston disk 34 which separates a cylinder 33 into cylinder halls 33*a* and 33*b*. The primary pressure $P_1$ is supplied into the cylinder hall 33*a* and $P_2$ into the cylinder hall 33*b*. Consequently, the piston 34 is moved toward the stop valve 27 or 30 depending on the pressure difference between both primary pressures $P_1$ and $P_2$.

In order to actuate the associated stop valves, the automatic gas distributing device has actuating paths 15 and 16 corresponding to the flow paths 9 and 10. The actuating path 15 comprises an inlet port 37, a cylinder hall 33*a*, a port 40, a cylinder hall 41, a port 42 and a cylinder hall 43. The actuating path 16 also comprises a port 39, a cylinder hall 33*b*, a port 48, a cylinder hall 49, a port 50, and a cylinder hall 51.

Figure 5:
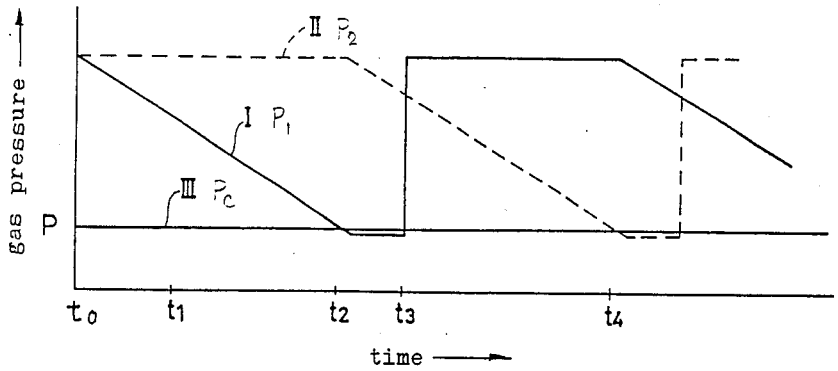
FIG. 5 is a time diagram, illustrating the change of the primary pressures $P_1$ and $P_2$ over time with respect to the first embodiment.

In a special case where the primary pressures $P_1$ and $P_2$ are almost equal, at time $t_0$ as shown in FIG. 5, almost no pressure difference is applied to the piston 34. Thus, the performance of the stop valves 27 and 30 becomes unstable, since there is no priority of operation between the high pressure vessels 1 or 2 since the primary pressures are approximately equal. This case occurs when a gas supply system operations for the first time with newly installed two full high pressure vessels. Only one of the two stop valves, the stop valve 5, for example, where vessel 1 is to be in operation first, is opened. After a short time, when $P_1$ is fairly lower than $P_2$, the stop valve may be closed. That is, the equal pressurization problem may be overcome manually at the time of installation of the two full high pressure vessels 1 and 2 into the gas supply system.

In summary, when the primary pressure $P_1$ is lower than $P_2$, the stop valve 27 is opened and the stop valve 30 is closed. When $P_1$ is higher than $P_2$, the stop valve 30 is opened. When $P_1$ is higher than $P_c$, the stop valve 29 is opened, and the stop valve 31 is closed. When $P_1$ is lower than $P_c$, the stop valve 29 is closed and the stop valve 31 is opened. When $P_2$ is higher than $P_c$, the stop valve 32 is opened and the stop valve 28 is closed. When $P_2$ is lower than $P_c$, the stop valve 32 is closed and the stop valve 28 is opened.

With this configuration, the operation of the automatic gas distributing device 20 will be described referring to FIG. 5, a time diagram illustrating the change of the primary pressures $P_1$ and $P_2$ with time. It is assumed that, at time $t_1$, the primary pressure $P_1$ is lower than $P_2$, and higher than the control pressure $P_c$. FIG. 3 illustrates this state, namely, $P_1=50$ Kg/cm$^2$, $P_2=100$ Kg/cm$^2$, and $P_c=5$ Kg/cm$^2$. As is seen from FIG. 3 and FIG. 4, the stop valves 29 and 32 are opened and the stop valves 28 and 31 are closed because both primary pressures $P_1$ and $P_2$ are higher than $P_c$. However, the stop valve 27 is opened and the stop valve 30 is closed, opening the flow path 9. The gas flow is indicated by dotted lines, and is supplied to the utilization pipe 60 from the high pressure vessel 1.

Figure 6:
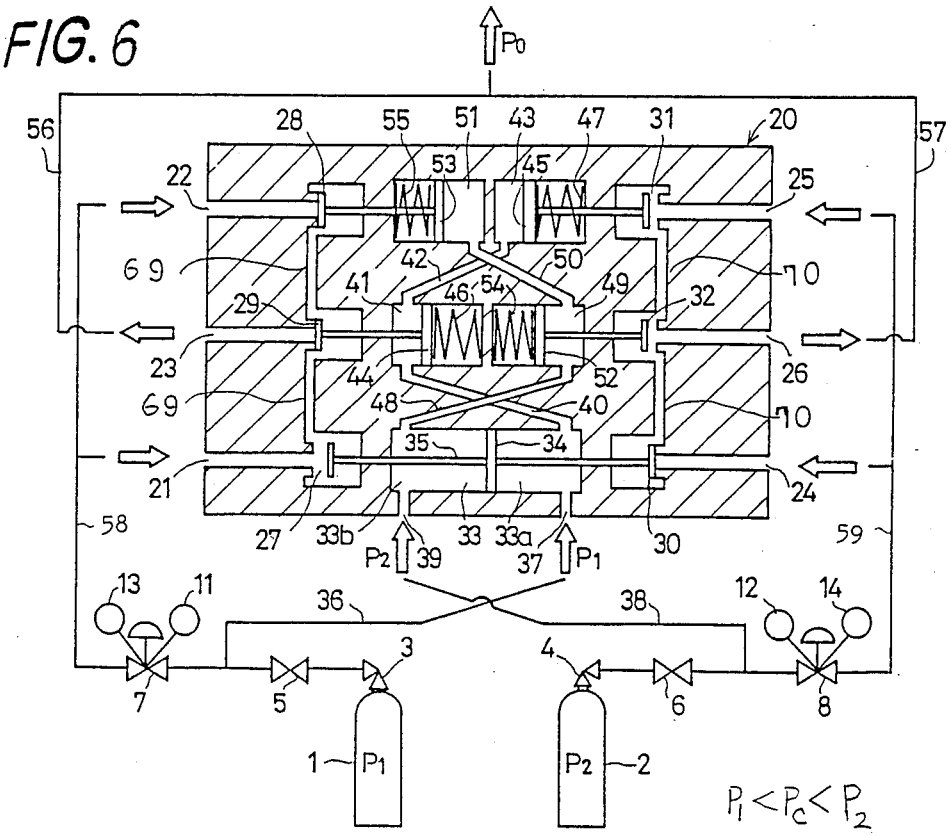
FIG. 6 is a schematic cross-sectional view of the first embodiment of the present invention, illustrating the state at time $t_2$ is shown in the time diagram of FIG. 5.
Figure 7:
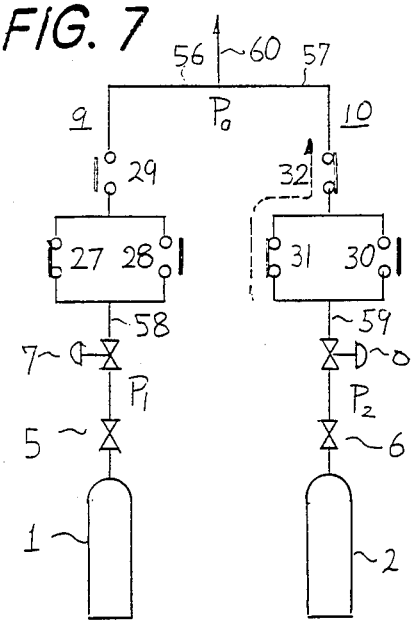
FIG. 7 is a diagram illustrating a gas flow of the automatic gas distributing device which is in the state shown in FIG. 6.

As the primary pressure $P_1$ reduces over time, draining the high pressure vessel 1, at a time $t_2$, $P_1$ becomes lower than $P_c$, resulting in closing the stop valve 29 and opening the stop valve 31 as shown in FIG. 6 and FIG. 7. Because the primary pressure $P_1$ is still lower than $P_2$, and $P_2$ is higher than $P_c$, the state of the other stop valves remains unchanged. Accordingly, the flow path 9 is closed by the closed stop valve 29, and, at the same time, the flow path 10 is opened by the opened stop valve 31 which by-passes the closed stop valve 30. The gas now flows through the flow path 10 as represented by a dotted line in FIG. 7. The supply of the low pressure gas to the utilization pipe 60 is thus maintained without any breakdown. After the switchover from the high pressure vessel 1 to the high pressure vessel 2, at time $t_3$, the drained high pressure vessel 1 is replaced by a full high pressure vessel. The primary pressure $P_1$ goes up again to a high pressure such as 100 Kg/cm$^2$.

Figure 9:
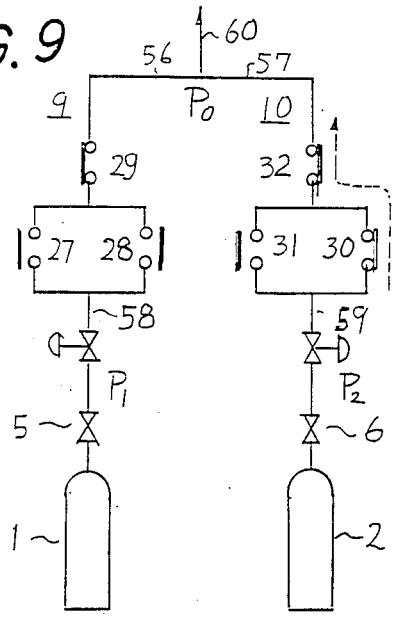
FIG. 9 is a diagram illustrating a gas flow of the automatic gas distributing device which is in the state shown in FIG. 8.
Figure 8:
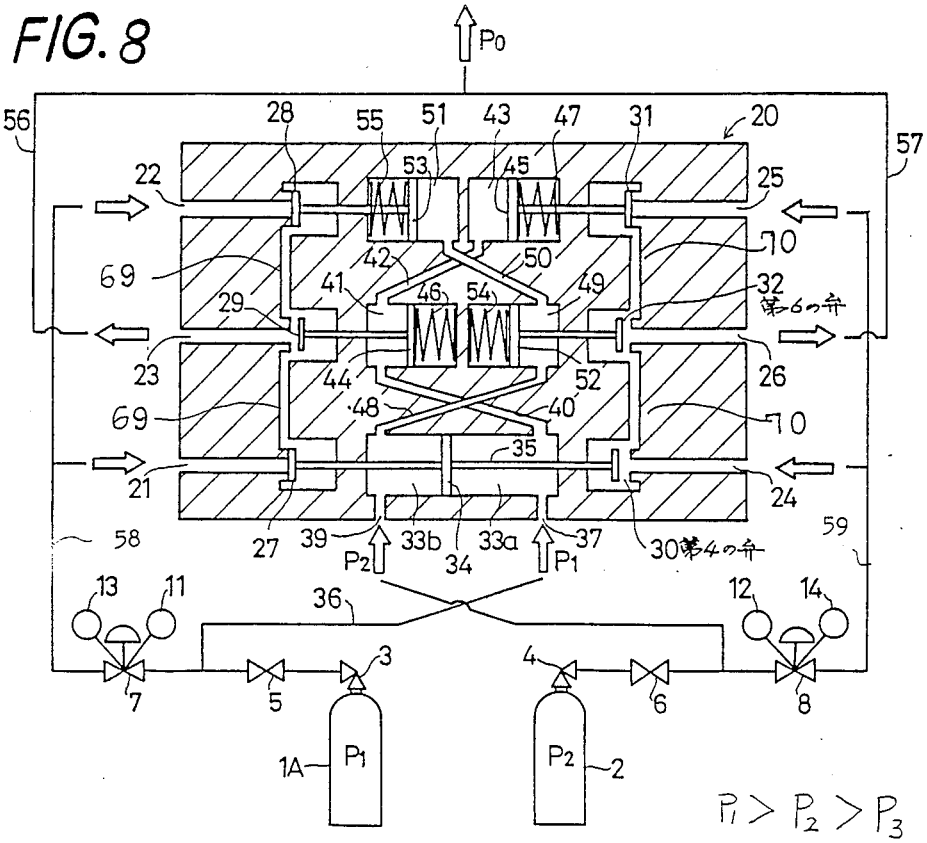
FIG. 8 is a schematic cross-sectional view of the first embodiment of the present invention, illustrating the state at time $t_3$ as shown in the time diagram of FIG. 5.

FIG. 8 illustrates the state of the device 20, and FIG. 9 is a corresponding diagram illustrating the passage of the gas at time $t_3$. Because the primary pressures $P_1$ and $P_2$ are higher than $P_c$, the stop valves 29 and 32, are opened, and the stop valves 28 and 31 are closed. However, since the primary pressure $P_1$ is higher than the primary pressure $P_2$, the stop valve 30 is opened and the stop valve 27 is closed, resulting in opening the flow path 10 and closing the flow path 9, and the gas flows as indicated by a dotted line. Thus, the closed stop valve 31 of the flow path 10 is by-passed by the stop valve 30. The gas stored in the high pressure vessel 2 is gradually consumed over time, and the primary pressure $P_2$ of the high pressure vessel 2 is reduced, becoming lower than the control pressure $P_c$ at time $t_4$.

Figure 10:
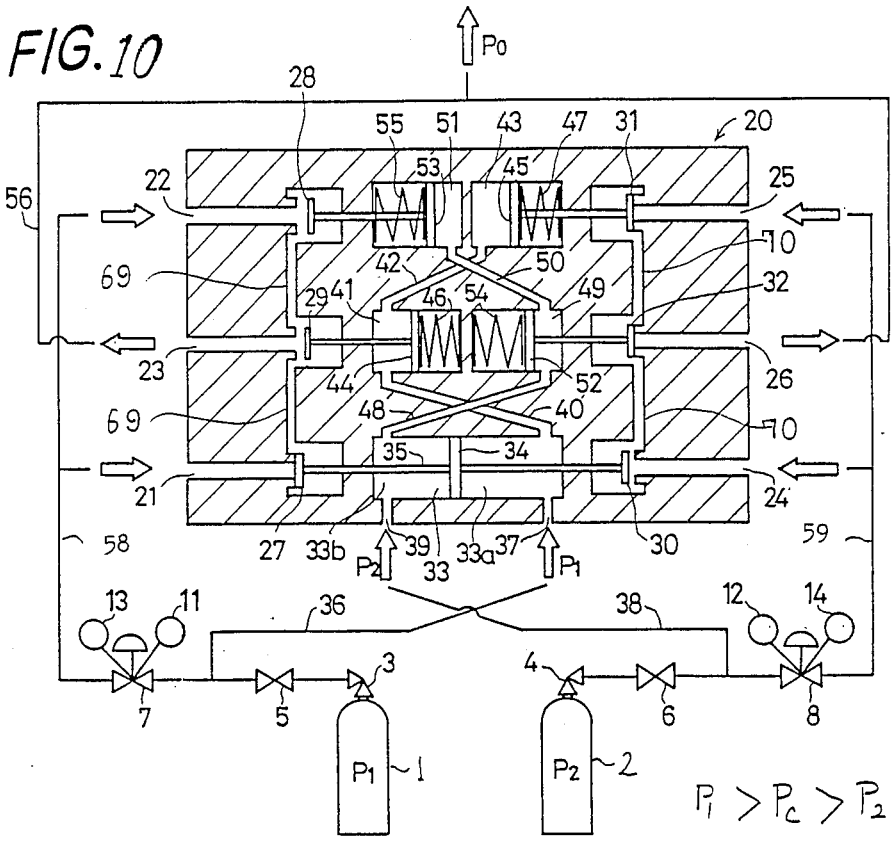
FIG. 10 is a schematic cross-sectional view of the first embodiment of the present invention, illustrating the state at time $t_4$ as shown in the time diagram of FIG. 5.
Figure 11:
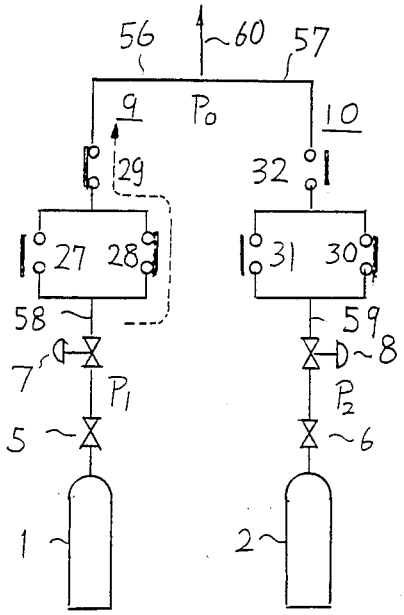
FIG. 11 is a diagram illustrating a gas flow of the automatic gas distributing device which is in the state shown in FIG. 10.

As shown below in FIG. 10, the reduction of the primary pressure $P_2$ below the $P_c$, makes the stop valve 32 close and the stop valve 28 open. The other stop valves remain unchanged because $P_1$ is still higher than $P_2$ and $P_1$ is still at high pressure, higher than $P_c$. Consequently, the flow path 9 is opened and the flow path 10 is closed at the same time. The gas is now supplied from the high pressure vessel 1 again through the flow path 9 as represented by dotted lines in FIG. 11. The high pressure vessel 2 is in a drained state to be replaced with another fresh high pressure vessel.

Figure 12:
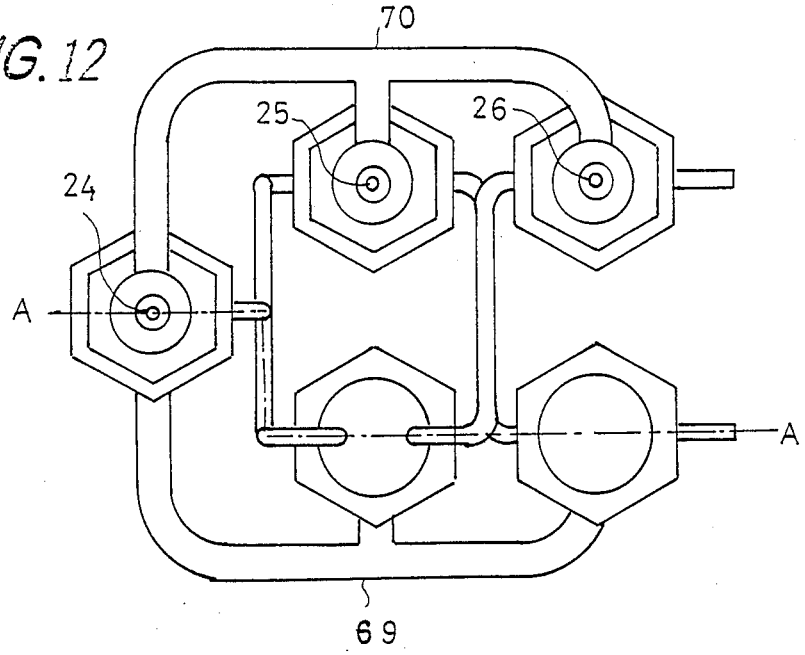
FIG. 12 is a plan view of an actual example of the first embodiment, illustrating the arrangement of the pneumatic components and connecting pipes.
Figure 13:
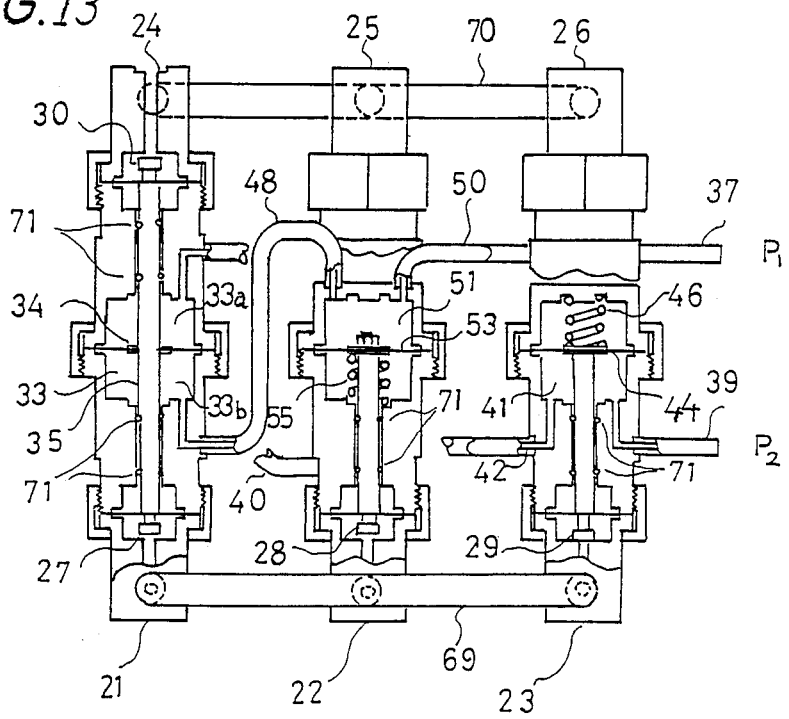
FIG. 13 is a cross-sectional view of the first embodiment shown in FIG. 12 taken along the chain line A—A of FIG. 12, illustrating the actual structure of the first embodiment.

FIG. 12 is a plan view of an actual example of the first embodiment, and FIG. 13 is a cross-sectional view of the same, taken along the chain line A—A of FIG. 12. Reference numerals represent the corresponding parts shown in the preceding drawings. The connection between pneumatic parts are preformed generally using stainless pipes. The stop valves are seat valves, which may be displaced by stop valves of other types. The pistons shown in the preceding drawings, such as FIG. 3, are replaced by diaphragms whose cross-sections are represented by straight lines in FIG. 13, and each piston plunger is supported by a pair of O-rings 71. The relevant pneumatic parts are conventional ones available in the market, and no further description regarding FIG. 12 and FIG. 13 may be necessary to those skilled in the art.

As described in detail, the alternative supply of the gas to the utilization pipe 60 is continued automatically by the automatic gas distributing device 20 of the present invention. All the stop valves are driven utilizing the primary pressures $P_1$ and $P_2$ propagated through the actuating paths 15 and 16. The stop values require no additional electrical or pneumatic power source or components to set up a controlling system for controlling the stop valves. As the result, the structure of the automatic gas distributing device, according to the first embodiment of the present invention, is substantially simplified, assures a reliable gas supply operation and is a device which is low in cost.

The first embodiment contains only two high pressure vessels which are alternatively used. If the capacity of each high pressure vessel is small, then replacement of the drained high pressure vessel with a new full high pressure vessel will be required frequently. In such a case, a number of high pressure vessels are desired to be installed on stand-by for replacing several drained high pressure vessels at a time. The principle of the first embodiment having two high pressure vessels is now extended to a case wherein more than two high pressure vessels are prepared for stand-by. Basically, the high pressure vessels are connected in a ring connection, and successively and alternatively operated in a direction such as anti-clockwise. The pneumatic parts, high pressure vessels, connecting means, etc. of the second embodiment, are quite similar to those of the first embodiment. The description of the second embodiment, therefore, will be provided referring to flow path diagram of FIG. 14 only, and that of structural configuration is omitted.

Figure 14:
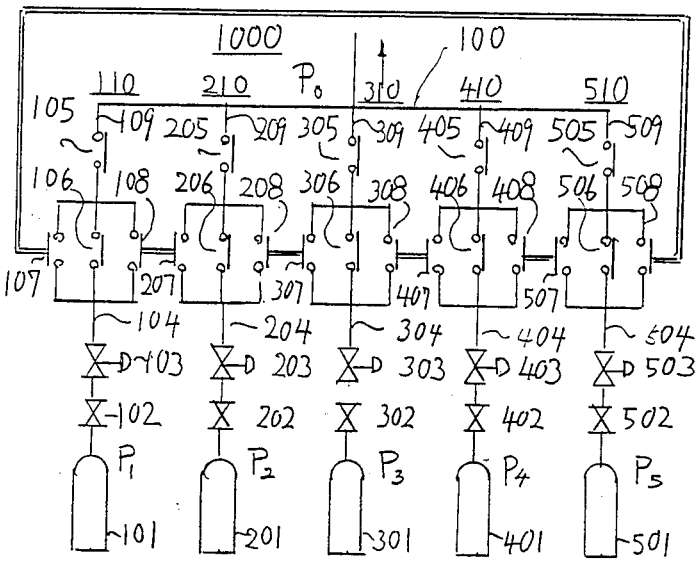
FIG. 14 is a diagram illustrating a gas flow of the automatic gas distributing device of the second embodiment of a supply system having five high pressure vessels.

The gas supplying apparatus having an automatic gas distributing device 1000 of the second embodiment, includes five high pressure vessels, 101, 201, 301, 401, and 501 having primary pressures $P_1$, $P_2$, $P_3$, $P_4$, and $P_5$ respectively as shown in FIG. 14. The gas under utilization pressure $P_0$, is alternatively delivered from one of the high pressure vessels and supplied to a common utilization pipe 100. The automatic gas distributing device 1000 has flow paths 110, 210, 310, 410, and 510 corresponding to the high pressure vessels 101 to 501. For example, the flow path 110 is interposed by a first stop valve 105, a second stop valve 106, a third stop valve 107, and a fourth stop valve 108. As shown in FIG. 14, and in a similar manner to the first embodiment, the stop valves 106, 107, and 108 are disposed in parallel, and the stop valve 105 is disposed in series with the stop valves disposed in parallel. The first stop valve 105 is opened when the primary pressure $P_1$ is higher than a control pressure $P_c$, closing when lower than $P_c$, closing the flow path 101. The second stop valve 106 is opened when the preceding primary pressure $P_5$ of the preceding high pressure vessel 501 is lower than $P_c$, and closed when higher than $P_c$. The fourth stop valve 108 is opened when the next primary pressure $P_2$ of the high pressure vessel 201 is higher than $P_1$. The third stop valve 107 is opened when the preceding primary pressure $P_5$ is higher than the primary pressure $P_1$.

For example, when the primary pressure $P_1$ of the high pressure vessel 101 in operation is reduced below the control pressure $P_c$ and the high pressure vessel 101 is drained off, the first stop valve 105 is closed, cutting off the associated flow path 110, and the second stop valve 206 of the next flow path 210 is opened. The first stop valve 205 of the flow path 210 has been already opened because the high pressure vessel 201 on stand-by has a high primary pressure $P_2$. Thus, the next flow path 210 is opened at the same time, putting the next high pressure vessel 201 in operation. In this manner, when the high pressure vessel in operation is drained and the primary pressure thereof is reduced below the control pressure $P_c$, then the flow path of the drained high pressure vessel is closed and the flow path for the next high pressure vessel on stand-by is opened. Thus, the exchange of a drained high pressure vessel for the next high pressure vessel on stand-by is performed automatically. Since the high pressure vessels are connected in a ring connection, the exchange can be continued successively as long as the drained high pressure vessels are replaced with full high pressure vessels at an appropriate time. This means that two or more drained high pressure vessels can each be replaced at a single time, and not individually for each replacement for full high pressure vessel, providing a convenience operation for an operator.

During the operation of the gas supply system, the drained high pressure vessel immediately preceding the high pressure vessel in operation may be replaced with a full high pressure vessel. With the automatic gas distributing device having the above-described configuration, the high pressure vessel in operation is cut off, because the second stop valve is closed by the high primary pressure of the preceding high pressure vessel which has been newly replaced. In order to avoid this problem, a valve control means includes a third and fourth stop valve added to each of the above-described flow path as shown in FIG. 14. For example, in flow path 109, the third stop valve 107 and the fourth stop valve 108 are disposed in flow paths in parallel with the flow path including a second stop valve 106. With a similar configuration to the stop valves 27 and 30 of the first embodiment, the third stop valve 107 of the flow path 109 cooperates with the fourth stop valve 508 of the preceding flow path 509. The stop valves 107 and 508 are driven in accordance with the pressure difference between the relevant adjacent two high pressure vessels 101 and 501. Both stop valves 107 and 508 are mechanically connected as described above. Other third stop valves and fourth stop valves are disposed in the same manner. The fourth stop valve 108 and the third stop valve 207 of the next flow path 209 cooperate with each other. Since the primary pressures $P_5$ and $P_2$ are higher than $P_1$, in the above case, both third and fourth stop valves 107 and 108 are opened. Although the second stop valve 106 is closed by the newly replaced high pressure vessel 501, the opened first stop valve 105, third stop valve 107 and fourth stop valve 108 open the flow path 109, resulting in the high pressure vessel 101 being in operation. In comparison with the first embodiment, the first stop valves, the second stop valves, and both of the third and fourth stop valves of the second embodiment, correspond to the stop valve 29, the stop valve 28 and the stop valve 27 of the first embodiment. Because of the ring connection of the high pressure vessels, in the second embodiment, the fourth stop valves are necessary in addition to the third stop valves in each flow path.

The replacement of the drained high pressure vessels is desirable to be performed in due order in order to avoid having plural high pressure vessels in operation. Assuming that a high pressure vessel 301 is in operation, and high pressure vessels 101 and 201 are drained, for example. If the high pressure vessel 201 is replaced first, and the high pressure vessel 101 remains drained, then the second stop valve 206 is also opened so that the high pressure vessel 201 is also in operation. Thus, two high pressure vessels 202 and 301 are in operation, which is not desirable in order to maintain a steady gas supply system.

The second embodiment is described with five high pressure vessels installed in the relevant gas supply system. However, it is apparent that the technology is applicable to systems including three, four or more than five high pressure vessels.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended Claims rather than by the foregoing description.

We claim:

1. An automatic gas distributing device installed in a gas supply system for supplying a utilization pipe with gas at a low predetermined secondary pressure, the gas coming from either of first and second high pressure vessels initially containing said gas under a high primary pressure which is regulated into said secondary pressure, said automatic gas distributing device comprising:

two flow paths corresponding to said first and second high pressure vessels, each flow path containing a plurality of stop valves actuatable by said primary pressure of the gas contained in said first and second high pressure vessels, each flow path receiving said gas under said secondary pressure from the corresponding high pressure vessel, and each flow path issuing said gas under the secondary pressure into said utilization pipe; and two actuating means corresponding to said first and second high pressure vessels, for selectively applying the primary pressures of the gas contained in the corresponding high pressure vessels to said stop valves contained in said flow paths to actuate said stop valves;

said stop valves contained in each of said flow paths including a first stop valve actuated by the primary pressure of the gas contained in the corresponding high pressure vessel, a second stop valve being disposed in series with said first stop valve, and being actuated by the primary pressure of the gas contained in another high pressure vessel; and a third valve disposed in a flow pass which by-passes said second stop valve, and being actuated by the difference between the pressures of the gas contained in both high pressure vessels.

2. An automatic gas distributing device installed in a gas supply system for supplying a utilization pipe with low pressure gas at a predetermined utilizing pressure, the gas coming from either of first high pressure vessel under a first primary pressure and a second high pressure vessel under a second primary pressure, initially containing said gas under a high primary pressure which is regulated to a secondary pressure as low as said predetermined utilizing pressure by a respective pressure regulator, said automatic gas distributing device comprising:

a first flow path for passing said gas under said secondary pressure from said first high pressure vessel, said first flow path having a first stop valve, second stop valve which is connected in series with said first stop valve and a third stop valve disposed in a first by-pass flow path by-passing said second stop valve;

a second flow path for passing said gas under said secondary pressure coming from said second high pressure vessel, said second flow path having a fourth stop valve, fifth stop valve which is connected in series with said fourth stop valve, and a sixth stop valve disposed in a second by-pass flow path by-passing said fifth stop valve;

a first actuating means for said first high pressure vessel, for applying the first primary pressure of the gas contained in said first high pressure vessel to said stop valves in said first flow path to control said stop valves in said first flow path; and a second actuating means for said second high pressure vessel, for applying said second primary pressure of the gas contained in said second high pressure vessel to stop valves in said second flow path to control said stop valves in said second flow path, said first stop valve of said first flow path and said fifth stop valve of said second flow path being operated in accordance with said first primary pressure of the gas contained in said first high pressure vessel and a predetermined control pressure, said fourth stop valve of said second flow path and said second stop valve of said first flow path are operated in accordance with said second primary pressure of the gas contained in said second high pressure vessel and said predetermined control pressure, and said third and sixth stop valves being operated cooperatively in accordance with the difference between said first and second primary pressures.

3. An automatic gas distributing device of claim 2, wherein said first and fourth stop valves each comprises a valve seat, a valve plunger, a piston connected to the valve plunger, a cylinder hall slidably accepting the piston, and a coil spring, said coil spring energizing the plunger in a direction toward the valve seat with a spring force corresponding to said predetermined control pressure.

4. An automatic gas distributing device of claim 2, wherein said second and fifth stop valves each comprises a valve seat, a valve plunger, a piston connected to the valve plunger, a cylinder hall slidably accepting the piston and a coil spring, said coil spring energizing the plunger in an opposite direction toward the valve seat with spring force corresponding to said predetermined control pressure.

5. An automatic gas distributing device of claim 2, wherein said third and sixth stop valves are disposed in the form of a sliding differential switching valve comprising two plunger heads, a rod mechanically connecting both plunger heads, a piston disposed on a portion of said rod located between said plunger heads, and a hall accepting said piston slidably.

6. An automatic gas distributing device of claim 2, wherein said first valve of said first flow path is opened, and said fifth stop valve of said second flow path is closed, when said first primary pressure of the gas contained in said first high pressure vessel is higher than said predetermined control pressure, and said first and fifth valves operate in the opposite state, when said first primary pressure is lower than said predetermined control pressure.

7. An automatic gas distributing device of claim 2, wherein said fourth valve of said second flow path is opened, and said second stop valve of said first flow path is closed, when said second primary pressure of the gas contained in said second high pressure vessel is higher than said predetermined control pressure, and said fourth and second stop valves operate in the opposite state when said secondary primary pressure is lower than said predetermined control pressure.

8. An automatic gas distributing device of claim 3 or 4, wherein said predetermined control pressure is set at a pressure close to said utilization pressure.

9. An automatic gas distributing device of claim 2, wherein said third valve of said first flow path is opened and said sixth stop valve of said second flow path is closed simultaneous, when the first primary pressure is lower than the second primary pressure, and said third and sixth stop valves are operated in the opposite state when the first primary pressure is higher than the second primary pressure.

10. An automatic gas distributing device of claim 2, said first flow path being established and said second flow path being interrupted when the first primary pressure is higher than said predetermined control pressure and lower than the second primary pressure, and said second flow path being established and said first flow path being interrupted when the second primary pressure is higher than said predetermined control pressure and lower than the first primary pressure.

11. An automatic gas distributing device of claim 4 or 5, wherein said pistons are diaphragms.

12. An automatic gas distributing device installed in a gas supply system for supplying a utilization pipe with gas at a predetermined low secondary pressure, the gas coming from one of a plurality of high pressure vessels arranged in a circulating connection, the gas initially being contained in said high pressure vessels under a high primary pressure, and being regulated into said secondary pressure gas by associated gas regulators, said automatic gas distributing device comprising:

a plurality of flow paths disposed corresponding to said plurality of high pressure vessels, each flow path containing a plurality of stop valves actuatable by the application of said primary pressures of the gas of said plurality of high pressure vessels, each flow path receiving said gas under said secondary pressure supplied from the corresponding high pressure gas vessel, and issuing said gas into said utilization pipe; and a plurality of actuating means disposed corresponding to said plurality of high pressure vessels, for alternatively applying said primary pressures of the gas contained in the associated high pressure vessels to said stop valves contained in said flow paths to actuate said stop valves, said stop valves contained in each of said flow paths including a first stop valve being actuated by the primary pressure of the gas contained in the associated high pressure vessel, a second stop valve being disposed in series with said first stop valve, said second stop valve being actuated by primary pressure of the gas contained in the high pressure vessel of a preceding stage, a third valve disposed in a flow path which bypasses said second stop valve, said third valve being actuated by the difference between the primary pressures of the gas contained in the associated high pressure vessel and the high pressure vessel of the preceding stage, and a fourth valve disposed in a flow path which bypasses said second stop valve, said fourth valve being actuated by the difference between the primary pressures of the gas contained in the associated high pressure vessel and the high pressure vessel of a next stage.

* * * * *